United States Patent [19]

Kesic et al.

[11] 4,105,989

[45] Aug. 8, 1978

[54] UHF SUBSTRATE TUNER POTENTIOMETER

[75] Inventors: Branimir Kesic, Park Ridge; Charles P. Pytlarz, Elmwood Park, both of Ill.

[73] Assignee: Zenith Radio Corporation, Glenview, Ill.

[21] Appl. No.: 740,162

[22] Filed: Nov. 8, 1976

[51] Int. Cl.[2] ..... H01C 10/40

[52] U.S. Cl. ..... 338/180; 338/176

[58] Field of Search ..... 338/180, 182, 183, 181, 338/87, 117, 125

[56] References Cited

U.S. PATENT DOCUMENTS

| | | | |
|---|---|---|---|
| 2,857,497 | 10/1958 | Bourns et al. | 338/183 |
| 2,873,339 | 2/1959 | Bourns et al. | 338/180 |
| 2,890,432 | 6/1959 | Rockafellow | 338/180 X |
| 3,412,362 | 11/1968 | Woods et al. | 338/183 |
| 3,703,699 | 11/1972 | Lahm et al. | 338/180 |
| 4,005,381 | 1/1977 | Klug | 338/183 X |

*Primary Examiner*—C. L. Albritton

*Attorney, Agent, or Firm*—Nicholas A. Camasto

[57] ABSTRACT

A potentiometer assembly for providing DC voltages for tuning the UHF channels of a varactor diode television tuner comprises a housing divided into a plurality of elongated compartments, each having a resistive element associated therewith. Each compartment is configured for slidably maintaining a replaceable contact-carrying carriage member disposed for engaging one of the resistive elements. A threaded shaft is removably associated with and longitudinally disposed within each of the compartments and is operable for driving a carriage member within its compartment to displace its associated contact member along the corresponding resistive element.

3 Claims, 6 Drawing Figures

UHF SUBSTRATE TUNER POTENTIOMETER

BACKGROUND OF THE INVENTION

This invention relates to potentiometer assemblies and, more particularly, to potentiometer assemblies of the type suitable for use in deriving tuning voltages in a varactor tuned television receiver.

Until relatively recently, channel tuning in television receivers has been accomplished by mechanical mechanisms which were operated to physically switch tuning elements in the appropriate tuning circuits. Although tuners of this type have provided excellent performance through the years, due to their inherent mechanical nature they have characteristically exhibited various long-recognized deficiencies.

Electronic tuning systems overcome many of the problems heretofore associated with conventional mechanical tuners. The practicality of such electronic tuners has been made possible by the varactor diode, an electronic component which exhibits an output capacitance determined by the DC voltage impressed across its terminals. Thus, television tuning may be enabled by utilizing a potentiometer assembly to appropriately vary the DC voltages applied to a series of varactor diode tuning elements.

Potentiometer assemblies suitable for use in electronic tuning applications are frequently classified as either single turn devices or multiple turn devices. Single turn potentiometers are normally circular in configuration and include an element capable of carrying a contact through a single revolution along a resistive member. Conventionally, single-turn circular type potentiometers are most frequently found in VHF applications. Multiple-turn potentiometers are normally elongated linear type structures configured for receiving a threaded shaft which is operable for driving a contact carrying carriage member along a resistive element. Although not necessarily so limited, potentiometer assemblies of the latter type are particularly suitable to UHF applications where a rather large frequency band must often be entirely covered by the manipulation of a single potentiometer.

Prior art multiple-turn elongated type potentiometer assemblies have generally taken the form of individual rectangular housings configured for permanently and non-replaceably retaining its associated threaded shaft and carriage member. Consequently, if, during testing of the potentiometer assembly itself, or a finished tuner address assembly or sub-assembly, a defect is discovered in a potentiometer, the applicable maintainance action is to discard the entire potentiometer assembly in favor of a new unit. This is, of course, an economically wasteful procedure especially where the defect is attributable only to a minor component of the entire assembly. Moreover, in television tuning applications, a multiplicity of similar potentiometers are required, thus adding to the difficulty.

Futher, prior art multiple-turn potentiometer assemblies are prone to various deficiencies in their stability characteristics. Particularly in electronic television tuners where a single potentiometer is used to cover the entire UHF frequency spectrum the potentiometer carriage member be positionable with relative precision to produce a finely controllable tuning voltage for application to the tuning elements. Any appreciable change in resistance at the set position of the contact member may result in a detuning of the receiver. Extremely stable positional characteristics are also required in applications where a ceramic substrate or the like characterized by a patterned resistive coating is utilized in association with the potentiometer assembly to provide the requisite resistve member. In such cases, any misalignment or drift of the potentiometer assembly contact member relative to the substrate can result in a change in contact resistance which may detrimentally effect the performance of the tuning system.

Finally, it will be appreciated that the carriage member of a multiple-turn potentiometer assembly of the type described above will be limited in its extent of travel at either end of the potentiometer housing. Accordingly, it would be highly desirable to provide a mechanism to protect the unit from damage should, through inadvertence or otherwise, the threaded shaft be operated to attempt to drive the carriage member beyond its physical limit of travel in either direction.

OBJECTS OF THE INVENTION

In view of the foregoing, it is a basis object of the present invention to provide a novel multiple-turn potentiometer assembly.

Another object of the present invention is to provide an improved multiple-turn potentiometer assembly which is relatively inexpensive to use.

SUMMARY OF THE INVENTION

The potentiometer assembly of the present invention comprises a housing having at least one elongated compartment and a resistive element associated therewith. Preferably, the resistive element comprises a ceramic substrate having an appropriately patterned resistive coating deposited thereon. A replaceable carriage member is slidably maintained within the elongated compartment and includes a contact member disposed for engaging the resistive coating of the ceramic substrate. A removable threaded shaft, operable for driving the carriage member, is longitudinally disposed within the elongated compartment. As the carriage member is driven, the contact member is displaced along the resistive coating on the substrate.

The positional stability of the contact member, relative to the resistive coating is enhanced by the carriage member including bias means exerting a force against the side walls of the compartment. Thus, the carriage member is loaded while seated within the compartment which minimizes the possibility of unintended displacement between the contact member and the resistive coating. The carriage member includes a clutching mechanism for effecting momentary disengagement with the threaded shaft when it reaches its limit of travel.

In another aspect of the invention a plurality of potentiometer assemblies are housed in a single housing which is divided into a plurality of individual compartments disposed in substantially a side-by-side relationship. A substrate having cooperating multi-patterned resistive coatings is disposed in operative association with the housing and potentiometer assemblies. Each of the compartments has a replaceable contact-carrying carriage member and a cooperating removable shaft operable as described above.

DESCRIPTION OF THE PREFERRED EMBODIMENT

Figure 1:
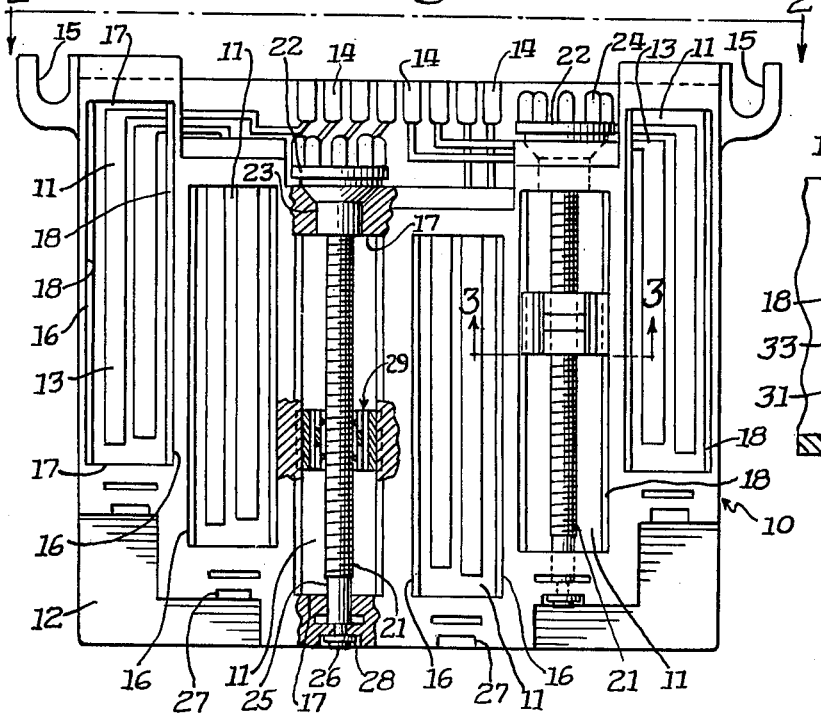
FIG. 1 is a front elevation view of the potentiometer assembly of the present invention having resistance varying means associated with two of its six compartments.
Figure 3:
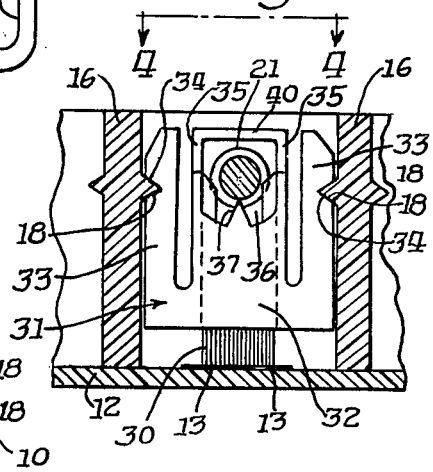
FIG. 3 is a view taken along line 3—3 of FIG. 1 illustrating a carriage member of the potentiometer assembly.
Figure 2:
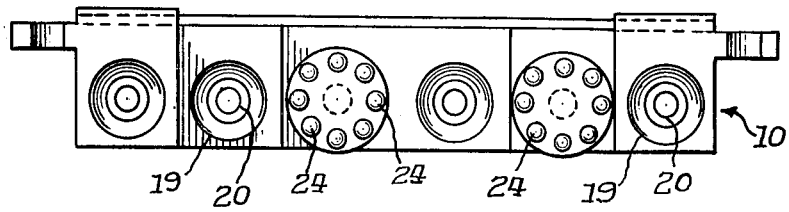
FIG. 2 is a view taken along line 2—2 of FIG. 1.
Figure 4:
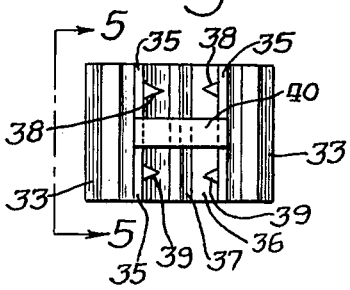
FIG. 4 is a view of the carriage member taken along line 4—4 of FIG. 3.
Figure 6:
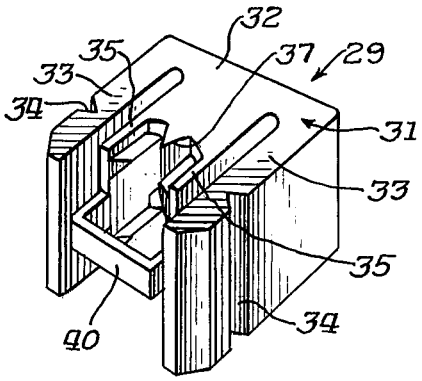
FIG. 6 is a perspective view of the carriage member shown in FIGS. 3-5.
Figure 5:
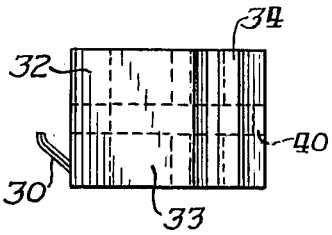
FIG. 5 is a view of the carriage member taken along line 5—5 of FIG. 4.

Referring now to the drawings, and particularly to FIGS. 1 and 2, the potentiometer assembly of the present invention comprises a housing 10 divided into a plurality of elongated compartments 11 disposed in side-by-side relationship to one another and in a generally planar orientation. Although housing 10 disclosed herein includes six elongated compartments 11 it will be appreciated that more or less than this number may be used as desired. Housing 10 is disposed overlying a planar member 12 characterized by a plurality of resistive elements. Planar member 12 preferably comprises a ceramic substrate having an appropriately patterned resistive coating 13 deposited thereon along with a series of associated output terminals 14. Resistive coating 13 is patterned to present a resistance element underlying each elongated compartment 11. A pair of generally U-shaped hook members 15 are disposed along either side of housing 10 and provide a facility for appropriately securing the potentiometer assembly.

Each elongated compartment 11 is defined by a pair of opposed and longitudinally extending side walls 16 and a pair of opposed and transversely extending end walls 17. In addition, a pair of longitudinal ribs 18 protrude inwardly of each compartment 11 from its associated side walls 16 and extend between transverse end walls 17. The transverse end walls associated with each compartment 11 include apertures 19, 20 for enabling a threaded shaft 21 to be received in each of the compartments. For purposes of clarity, only two threaded shafts 21 are shown as being received by compartments 11 in FIGS. 1 and 2.

Threaded shaft 21 includes at one end thereof a pin wheel member 22 operably connected to the shaft by a hub member 23. Hub member 23 is configured for snugly receiving threaded shaft 21 which is thereby rotatable in response to rotation of pin wheel 22. In this regard, pin wheel 22 includes a plurality of projecting fingers 24 which facilitate manual rotation thereof. The other end of threaded shaft 21 comprises a smooth cylindrical portion 25 terminating in a clip retaining portion 26 of reduced cross sectional dimension. When installed within compartment 11, hub member 23 is received in aperture 19, smooth cylindrical portion 25 is received in aperture 20 and clip retaining portion 26 extends into a depression 27 formed in housing 10. An appropriate retaining clip 28 may be slid into depression 27 and mated with clip retaining portion 26 to more positively secure threaded shaft 21 within compartment 11. Due to the foregoing construction it will be appreciated that threaded shaft 21 is easily removable from compartment 11 by simply removing retaining clip 28 and sliding the shaft out of the compartment through apertures 20 and 19.

In order to vary the resistance values of the portion of patterned coating 13 underlying each respective compartment 11 and presented at appropriate ones of output terminals 14, a contact carrying carriage member 29 is slidably and replaceably disposed within each of the compartments. Carriage member 29, which is most clearly shown in FIGS. 3 through 6, includes a contact member 30, preferably a micro brush or the like, depending therefrom and disposed for contacting the portion of patterned coating 13 underlying its respective compartment 11. As will be explained in further detail below, threaded shaft 21 is received by carriage member 29 and is operable for longitudinally driving the carriage member within compartment 11 to displace contact member 30 along patterned coating 13 for varying the output resistance of the potentiometer.

It will be noted that carriage member 29 includes an outer generally U-shaped portion 31 having a base 32 and a pair of upstanding opposed flexible arms 33. Each flexible arm 33 includes an exteriorly disposed and longitudinally extending groove 34 matable with ribs 18 of compartment side walls 16. To provide increased positional stability of carriage member 29 within compartment 11 the transverse dimension of ribs 18 are such that they cause arms 33 of the carriage member to flex slightly inwardly when seated in one of the compartments. As a result, flexible arms 33 exert an outward force transversely against ribs 18 thereby maintaining carriage member 29 loaded while seated in a compartment to minimize the possibility of any drift occurring between contact member 30 and its associated resistive element.

Extending upwardly from base 32 and spaced along side flexible arms 33 a pair of opposed resilient members 35 define a channel 36 through which shaft 21 passes. An inverted V-shaped structure 37 is included at the bottom of channel 36 forming a support for threaded shaft 21. In addition, each resilient member 35 carries a pair of inwardly disposed teeth 38 and 39 arranged for engaging the threads of threaded shaft 21. A pointer 40 bridges the resilient members 35 and provides a convenient means whereby the position of carriage member 29 within one of the compartments 11 may be observed.

Since threaded shaft 21 is held captive within compartment 11 it will be apparent that by rotating pin wheel 22, thereby causing shaft 21 to rotate, the cooperating action between the shaft and teeth 38 and 39 will cause carriage member 29, along with its associated contact member 30, to be longitudinally displaced within compartment 11 to vary a resistance value presented at output terminals 14. The direction of displacement of carriage member 29 within compartment 11 will, of course, depend upon the direction of rotation of pin wheel 22. Furthermore, as mentioned previously, the displacement and setting of carriage member 29 is accomplished with a high degree of positional stability since it is maintained in a loaded condition within its compartment.

The limits of longitudinal displacement of carriage member 29 within one compartment 11 are defined by end walls 17. To prevent the possibility of damage to carriage member 29 in response to the attempted displacement thereof beyond its limit of travel in abutment with either end wall 17 resilient members 35 are outwardly deflectable toward arms 33 for allowing teeth 38 and 39 to be momentarily displaced over the thread of shaft 21. That is, when pin wheel 22 is operated in an attempt to force carriage member 29 beyond its limit of travel, the thread of shaft 21 will act upon teeth 38 and 39 forcing resilient members 35 to flex outwardly and over the thread. Potential damage to carriage member 29, and particularly teeth 38 and 39 thereof, is thereby avoided by means of this clutching mechanism.

Finally, it will be appreciated that carriage member 29 is easily replaceable in the event that it is found inoperative. Replacement is accomplished by simply removing threaded shaft 21 from channel 36 and then slightly flexing arms 33 allowing the carriage member to drop form its compartment. Ceramic substrate 12 would, of course, be removed prior to such replacement of the carriage member.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

What is claimed is:

1. A potentiometer assembly comprising:

a housing having an elongated compartment, said compartment including a pair of opposed longitudinal side walls and a pair of opposed transversely extending end walls, each of said side walls including a longitudinal rib extending between said end walls and projecting within said compartment;

a resistive element associated with said compartment;

a replaceable carriage member slidably maintained within said compartment and carrying a contact member for engaging said resistive element, said carriage member comprising an outer generally U-shaped portion having a base and a pair of flexible arms extending therefrom, each of said flexible arms having an exterior longitudinal groove coacting with one of said ribs such that a uniform transverse force is exerted against said flexible arms by said ribs causing a slight inward flexing thereof for supporting and stabilizing the position of said carriage member relative to said compartment; and a threaded shaft removably associated with and longitudinally disposed within said compartment, said threaded shaft being operable for driving said carriage member within said compartment whereby, said contact member is displaced along said resistive element.

2. A potentiometer assembly according to claim 1 wherein the axis of said threaded shaft and said longitudinal ribs and grooves are substantially disposed in a common plane orthogonally intersecting said end walls and said side walls.

3. A potentiometer assembly according to claim 1 wherein said carriage member includes an inner generally U-shaped portion comprising:

at least two resilient members each extending from said base along side and spaced from the interior surface of a respective one of said flexible arms; and each of said resilient members carrying a plurality of inwardly disposed teeth for engaging the threads of said threaded shaft and being deflectable towards said flexible arms for allowing said teeth to be displaced over the thread of said threaded shaft in response to the attempted displacement of said carriage member beyond its limit of travel in abutment with said end walls by operation of said threaded shaft.

* * * * *